United States Patent [19]

Hayes

[11] 4,411,024

[45] Oct. 25, 1983

[54] PROTECTIVE GLOVE

[75] Inventor: J. Brian Hayes, Walhalla, S.C.

[73] Assignee: The Kendall Company, Walpole, Mass.

[21] Appl. No.: 220,503

[22] Filed: Dec. 29, 1980

[51] Int. Cl.[3] ..... A41D 13/08

[52] U.S. Cl. ..... 2/20; 2/161 A

[58] Field of Search ..... 2/16, 20, 158, 159, 2/161 A, DIG. 6

[56] References Cited

U.S. PATENT DOCUMENTS

| | | | |
|---|---|---|---|
| 3,605,117 | 9/1971 | Latina | 2/16 |
| 3,890,649 | 6/1975 | Diggins | 2/16 X |
| 4,067,063 | 1/1978 | Ettinger | 2/16 X |
| 4,295,229 | 10/1981 | Clark et al. | 2/20 |

*Primary Examiner*—Louis Rimrodt

[57] ABSTRACT

A contact sport protective glove adapted to cover the back of the hand comprising a flexible member which has a smooth hand-contacting, inner membrane and a tough outer protective membrane having a plurality of discrete foam-filled, protective protrusions spaced from one another by thin, narrow areas.

15 Claims, 8 Drawing Figures

FIG 1
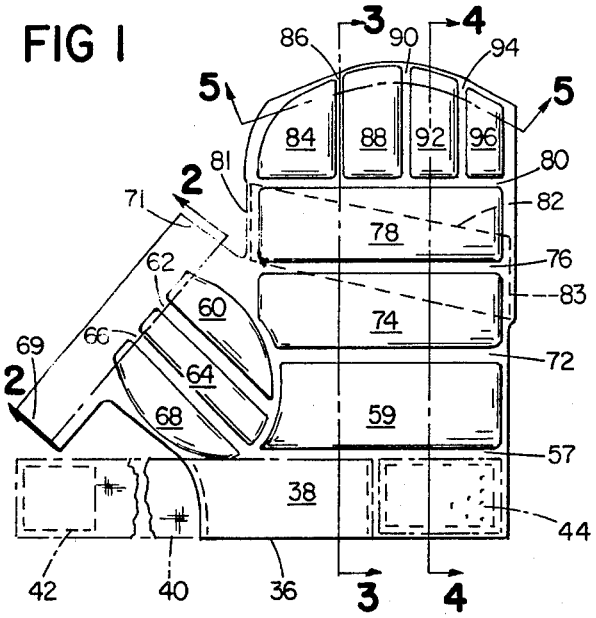
FIG 2
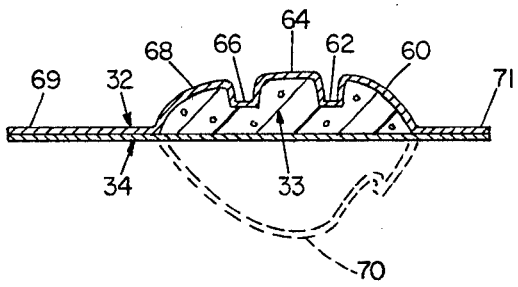
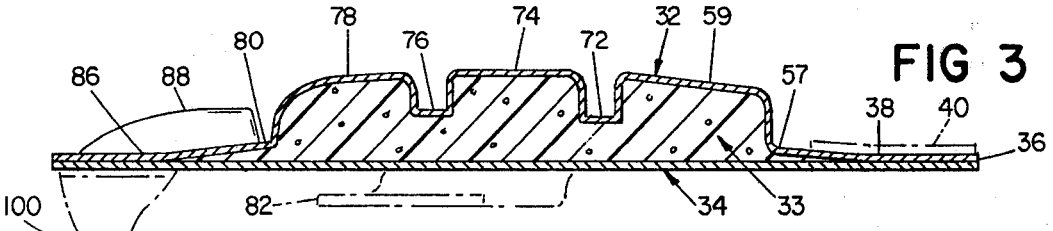
FIG 3
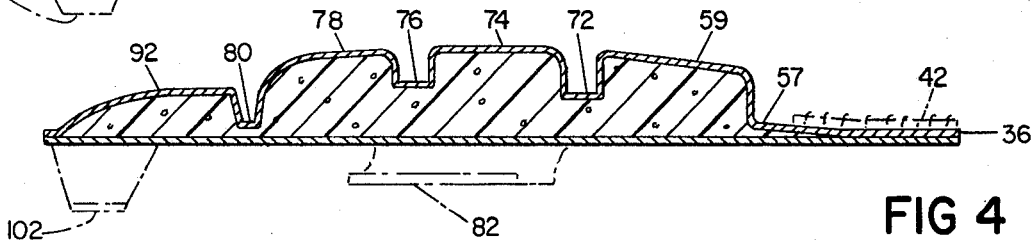
FIG 4
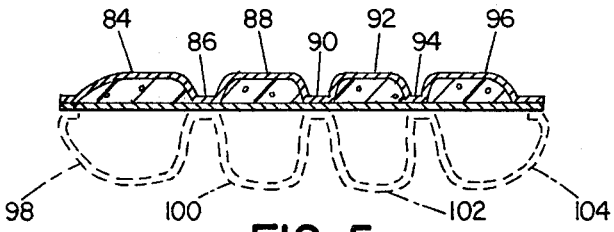
FIG 5

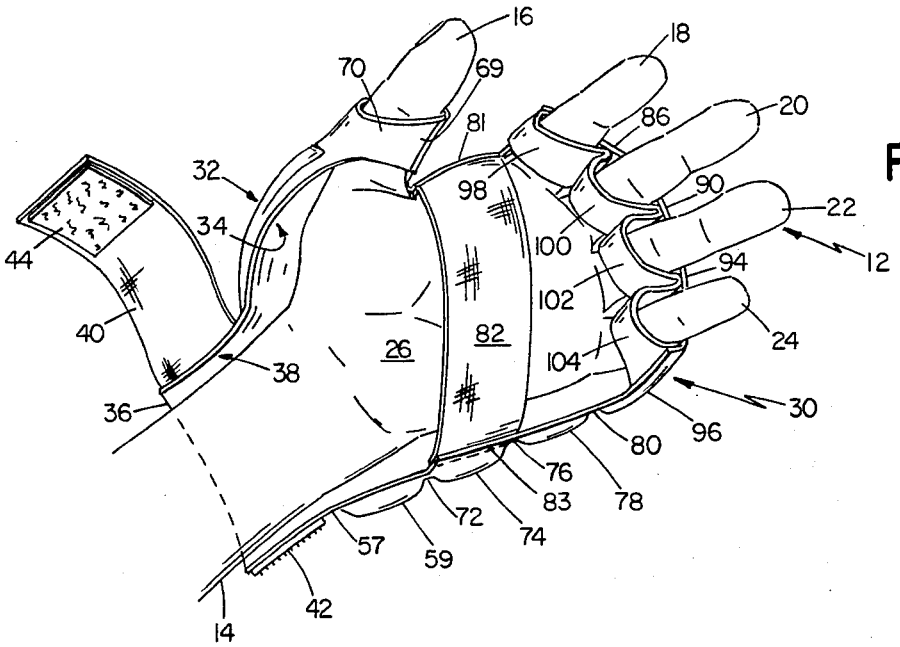
FIG 6
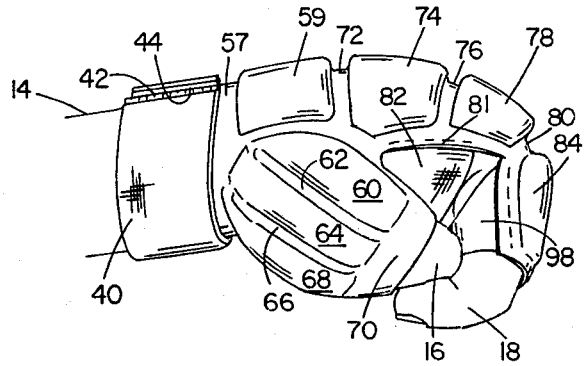
FIG 8
FIG 7
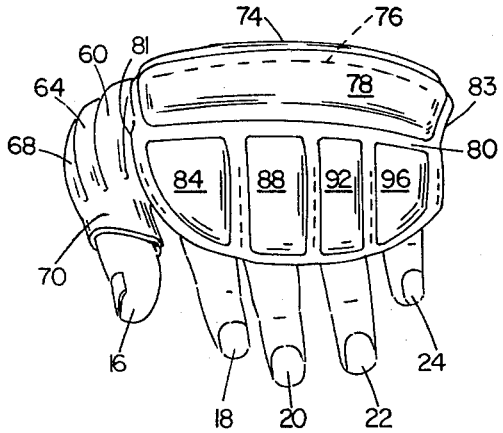

PROTECTIVE GLOVE

This invention relates to contact sport protective gloves and, more particularly, to gloves for protecting the hands of football players.

In the sport of football, a variety of protective gear has been developed to protect various parts of a player's body such as his head, shoulders, thighs, and knees. However, no specific gear is used to protect a player's hands, thus forcing the player, especially an "interior" lineman, to use protective paddings or wrappings that are not properly adapted to protect his hands. These paddings or wrappings are deficient in several aspects, such as being unduly bulky and unwieldy, seriously decreasing flexion of the fingers, abrading the hands and leaving sensitive areas such as knuckles, backs of hands, and wrists vulnerable to injury.

Accordingly, it is a major object of the present invention to provide a novel protective glove that protects the sensitive areas of the hand, such as knuckles, back of the hand, and wrist, allows flexion of the fingers, does not abrade the hands, is lightweight, and is easy to put on and take off.

In order to accomplish the above and still further objects, the present invention provides a contact sport protective glove adapted to cover the back of the hand, including at least a portion of the lower arm, the carpus, the metacarpus, the knuckles between the metacarpus and the fingers, and at least a portion of the thumb and four fingers. The protective glove comprises a flexible, preferably integrally molded, member which has a tough outer protective membrane and a smooth hand-contacting, inner membrane, the membranes being connected together around the peripheral edge of the member. The outer membrane has a plurality of discrete foam-filled protective protrusions spaced from one another by thin, narrow areas which include a lower arm area, at least one obliquely extending thumb area, transversely extending hand areas, and longitudinally extending finger areas.

The lower arm area extends transversely across the base of the member and preferably has secured thereto a securing strap for securing the base around the lower arm. The strap may have two pads of cohesive-adhesive material for releasably securing the strap. The transversely extending hand areas extend transversely between the opposite peripheral edges of the member, with the proximal one of the hand areas being connected to the lower arm area and the distal one of the hand areas providing a hinge line between the metacarpus and the fingers at the knuckles. The hand areas are longitudinally spaced from one another, defining at least one transversely extending hand-protective protrusion therebetween, the distal one of the hand-protective protrusions being adapted to overlie the knuckles of the hand. The hand areas may have an elastic band attached to the opposite peripheral edges of the member which extends across the inner membrane of the member for receiving the palm of the hand.

The obliquely extending thumb area is connected to the peripheral edge of the member at one side of the hand areas defining a plurality of obliquely extending thumb-protective protrusions. The thumb area may have attached thereto a gripping loop extending across the inner membrane of the member for receiving the thumb of the hand.

The longitudinally extending finger areas are connected at their proximal ends to the distal one of the hand areas and at their distal ends to the peripheral edge, the finger areas being transversely spaced from and parallel to one another defining a plurality of finger-protective protrusions. The finger areas have attached thereto for gripping loops extending across the inner membrane of the member, each adapted to receive one of the fingers.

Other objects, features, and advantages of the present invention will appear from the following detailed description of a preferred embodiment thereof, taken together with the accompanying drawings, wherein:

FIG. 1 is a plan view of the outer surface of a molded blank of the protective glove of the present invention;

FIGS. 2 through 5 are cross-sectional views of the protective glove of FIG. 1, taken along lines 2—2, 3—3, 4—4 and 5—5 thereof;

FIG. 6 is a perspective view of the protective glove of the present invention, shown as worn on an open hand and unsecured at the wrist;

FIG. 7 is a front view of the protective glove of FIG. 6; and

FIG. 8 is a side view of the protective glove of FIG. 6, shown as secured to the wrist and with the hand clenched.

Referring to the drawings, the flexible, integrally molded, contact sport protective glove of the present invention, generally designated 30, is shown as a blank in FIGS. 1 through 5 and is shown in FIGS. 6 through 8 as worn on a hand, generally designated 12.

More particularly, the novel protective glove 30 is adapted to cover the back of hand 12 including at least a portion of lower arm 14, the carpus, the metacarpus, the knuckles between the metacarpus and fingers 18, 20, 22, 24, and at least a portion of each of thumb 16 and four fingers 18, 20, 22, 24. Glove 30 comprises a flexible, integrally molded member which has a tough outer protective membrane 32 and a smooth hand-contacting, inner membrane 34, membranes 32 and 34 being connected together around the peripheral edge of the member. As best shown in FIGS. 1, 3 and 4, inner membrane 34 is generally flat in blank form and outer membrane 32 has a plurality of discrete foam-filled, protective protrusions which are spaced from one another by thin, narrow areas for providing the requisite flexibility, some of which additionally function as hinges. These thin, narrow areas include a lower arm area 36; thumb areas 62, 66; transversely extending hand areas 57, 72, 76, 80; and finger areas 86, 90, 94.

Lower arm area 36 extends transversely across base 38 of the member and has secured thereto an elastic securing strap 40 for securing base 38 around lower arm 14, as best shown in FIG. 6. Strap 40, which is sewn to base 38, has two pads 42, 44 of cohesive-adhesive material, pad 42 being of Velcro-like material and pad 44 being of felt-like material adapted to adhere to Velcro-like materials, for releasably securing strap 40.

The four hand areas 57, 72, 76, 80 extend transversely between the opposite peripheral edges of the member, the proximal one of the hand areas, area 57, being connected to base 38. Hand areas 57, 72, 76, 80 are longitudinally spaced from one another and define three transversely extending, foam-filled hand-protective protrusions 59, 74, 78 therebetween. The distal one of hand-protective protrusions, protrusion 78, is adapted to overlie the knuckles of hand 12. The distal one of the hand areas, area 80, provides a hinge line between the metacarpus and fingers 18, 20, 22, 24 at the knuckles. As best shown in FIG. 6, hand areas 57, 72, 76, 80 have an elastic band 82 attached to the opposite peripheral edge flaps 81, 83 of the member and extending across inner membrane 34 of the member for receiving palm 26 of hand 12.

The two obliquely extending thumb areas 62, 66, connected to the peripheral edge of the member adjacent hand-protective protrusions 59, 74, 78, 46, define three obliquely extending, foam-filled thumb-protective protrusions 60, 64, 68, as best shown in FIGS. 1 and 2. Thumb areas 62 and 66 have a gripping loop 70 which extends across inner membrane 34 of the member for receiving thumb 16 of hand 12, as best shown in FIG. 7. Loop 70 is made by sewing together two flaps 69, 71 provided on opposite sides of the distal ends of thumb areas 62, 66, as best shown in FIG. 1.

The three longitudinally extending finger areas 86, 90, 94 are connected at their proximal ends to the distal one of the hand areas, area 80, and are connected at their distal ends to the peripheral edge of the member. Finger areas 86, 90, 94, are transversely spaced from and parallel to one another and define four longitudinally extending, foam-filled finger-protective protrusions 84, 88, 92, 96, as best shown in FIGS. 1, 5 and 7. Finger areas 86, 90, 94 have attached thereto four flexible gripping loops 98, 100, 102, 104, which may be of any suitable material. Loops 98, 100, 102, 104, which are sewn to inner membrane 34, extend thereacross, each being adapted to receive one of fingers 18, 20, 22, 24, as best shown in FIG. 6.

In the preferred embodiment, a thick layer of resilient plastic foam material 33, such as $\frac{3}{4}$ inch polyethylene foam sheet, is interposed between outer membrane 32 and inner membrane 34 to provide a composite laminated sheet which is then molded. Outer membrane 32 is of a suitable plastic material such as vinyl sheet material with a stretch nylon backing. Inner membrane 34 is preferably of double knit polyester or other suitable textile material to minimize abrasion of hand 12. The thickness of foam 33 in the hand-protective protrusions, as best shown in FIGS. 2, 3, 4, 5 and 6, varies from $\frac{3}{8}$ of an inch in thumb-protective protrusions 60, 64, 68 and finger-protective protrusions 84, 88, 92, 96; and to $\frac{3}{4}$ of an inch in hand-protective protrusions 59, 74, 78.

In the blank shown in FIG. 1, the composite laminated sheet is molded to form the thin areas by pressing outer membrane 32 toward inner membrane 34. In some instances, for example, at lower arm area 36 and finger areas 86, 90, 94, membranes 32 and 34 are essentially in contact with one another and may function as hinges to permit sharp bends, such as at metacarpus area 80 shown in FIGS. 8 and 9. In other areas, such as in thumb areas 62, 66 and hand areas 72, 76, membranes 32 and 34 do not contact one another, but still provide the requisite flexibility.

In use, as best shown in FIGS. 6, 7 and 8, protective glove 30 is placed over the back of hand 12, with thumb loop 70 and finger loops 98, 100, 102, 104 receiving thumb 16 and fingers 18, 20, 22, 24, respectively. With band 82 receiving palm 26 of hand 12 and Velcro pad 42 of strap 40 adhered to pad 44, glove 30 is secured on hand 12 to protect a portion of lower arm 14, the carpus, the metacarpus, the knuckles between the metacarpus and fingers 18, 20, 22, 24, and a portion of each of thumb 16 and fingers 18, 20, 22, 24. With but a single elastic band 82 across palm 26 and flexible loops 98, 100, 102, 104 around fingers 18, 20, 22, 24, protective glove 30 allows flexion of the fingers, as illustrated in FIG. 8, while maintaining protection of sensitive areas such as knuckles, back of hand 12 and lower arm 14.

What is claimed is:

1. A contact sport protective glove adapted to cover the back of the hand including at least a portion of the metacarpus, the knuckles between the metacarpus and the fingers, and at least a portion of each of the thumb and four fingers, comprising a flexible member having a tough outer protective membrane and a smooth hand-contacting, inner membrane connected together around the peripheral edge of said member, said outer membrane having a plurality of discrete foam-filled, protective protrusions spaced from one another by thin areas providing bending of said member thereat, said thin areas including a plurality of transversely extending metacarpus areas extending between the opposite peripheral edges of said member, said metacarpus areas being longitudinally spaced from one another and defining at least one transversely extending metacarpus-protective protrusion therebetween, a generally longitudinally extending area intermediate the portion of said glove adapted to cover said metacarpus and the portion of said glove adapted to cover said thumb portion, a plurality of obliquely extending thumb areas connected at their proximal ends adjacent said longitudinal area and defining at least one thumb-protective protrusion therebetween, and a plurality of finger areas, connected at their proximal ends adjacent the distal one of said metacarpus areas and at their distal ends being adjacent said peripheral edge, said finger areas being spaced from and generally parallel to one another and defining at least one finger-protective protrusion therebetween.

2. The protective glove as claimed in claim 1, further including securing means for securing said member around a lower arm.

3. The protective glove as claimed in claim 1 or 2, wherein said portion of said glove adapted to cover said thumb portion has spaced from its proximal end a gripping loop extending across the inner membrane of said member for receiving said thumb, and a portion of said glove adapted to cover said finger portions has attached thereto four gripping loops extending across the inner membrane of said member, each of said loops adapted to receive one of said fingers.

4. The glove of claim 1 wherein said foam in said protrusions has thickness in the range of $\frac{3}{8}$ inch to $\frac{3}{4}$ inch.

5. The glove of claim 1 wherein said foam is a polyethylene foam.

6. The glove of claim 1 wherein said outer membrane is a vinyl sheet material with a stretch nylon backing.

7. The glove of claim 1 wherein said inner membrane is a knit polyester.

8. The glove of claim 1 wherein said flexible member is integrally molded.

9. The glove of claim 1 wherein said thin finger areas extend longitudinally and are transversely spaced from one another, defining at least one longitudinally extending finger-protective protrusion therebetween.

10. A contact sport protective glove adapted to cover the back of the hand including at least a portion of the lower arm, the carpus, the metacarpus, the knuckles between the metacarpus and the fingers, and at least a portion of each of the thumb and four fingers, comprising a flexible integrally molded member having a tough outer protective membrane and a smooth hand-contacting, inner membrane connected together around the peripheral edge of said member, said outer membrane having a plurality of discrete foam-filled, protective protrusions spaced from one another by thin, narrow areas providing bending of said member thereat, said thin areas including a lower arm area extending transversely across the base of said member and having secured thereto a securing strap for securing said base around said lower arm;

a plurality of transversely extending metacarpus areas extending between the opposite peripheral edges of said member, the proximal one of said metacarpus areas being connected adjacent said lower arm area, said metacarpus areas being longitudinally spaced from one another and defining at least one transversely extending metacarpus-protective protrusion therebetween, one of said metacarpus-protective protrusions being adapted to overlie the knuckles of said hand and the distal one of said metacarpus areas providing a hinge line between said metacarpus and said fingers near said knuckles;

a generally longitudinally extending area intermediate the portion of said glove adapted to cover said metacarpus and the portion of said glove adapted to cover said thumb portion, a plurality of obliquely extending thumb areas connected at their proximal ends adjacent said longitudinal area and defining at least one obliquely extending thumb-protective protrusion, said portion of said member adapted to cover said thumb portion having spaced from its proximal end a gripping loop extending across the inner membrane of said member for receiving said thumb; and a plurality of longitudinally extending finger areas connected at their proximal ends adjacent the distal one of said metacarpus areas and at their distal ends being adjacent said peripheral edge, said finger areas being transversely spaced from and generally parallel to one another and defining at least one longitudinally extending finger-protective protrusion therebetween, a portion of said member adapted to cover said finger portions having attached thereto four gripping loops extending across the inner membrane of said member, each of said loops adapted to receive one of said fingers.

11. The protective glove as claimed in claim 10, wherein said securing strap has two pads of cohesive-adhesive material for releasably securing said strap.

12. The protective glove as claimed in claim 1, 4 or 11, wherein said metacarpus areas have an elastic band attached to the opposite peripheral edges of said member extending across the inner membrane of said member for receiving the palm of said hand.

13. A flexible member of integrally molded sheet material having a tough outer protective membrane and a smooth inner membrane connected together around the peripheral edge of said member, said outer membrane having a plurality of discrete foam-filled, protective protrusions spaced from one another by thin areas providing bending of said member thereat, said member being sized and adapted to cover the back of a hand including at least a portion of the metacarpus, the knuckles between the metacarpus and the fingers, and at least a portion of the thumb and four fingers, and said thin areas including a plurality of transversely extending metacarpus areas extending between the opposite peripheral edges of said member, said metacarpus areas being longitudinally spaced from one another and defining at least one transversely extending metacarpus-protective protrusion therebetween, and a plurality of longitudinally extending finger areas connected at their proximal ends adjacent the distal one of said metacarpus areas and at their distal ends adjacent said peripheral edge, said finger areas being transversely spaced from and generally parallel to one another and defining a plurality of longitudinally extending finger-protective protrusions therebetween.

14. The member as claimed in claim 13 further including a generally longitudinally extending area intermediate the portion of said glove adapted to cover said metacarpus and the portion of said glove adapted to cover said thumb portion, a plurality of obliquely extending thin thumb areas connected at their proximal ends adjacent said longitudinal area, and wherein said portion of said member sized and adapted to cover said thumb portion defines at least one obliquely extending thumb-protective protrusion.

15. The member as claimed in claim 13 or 14 further including a lower arm area arranged and adapted to cover a portion of said lower arm and extending transversely across the base of said member.

* * * * *